US005192200A

United States Patent [19]

Lilie et al.

[11] Patent Number: 5,192,200

[45] Date of Patent: Mar. 9, 1993

[54] REED VALVE FOR A HERMETIC COMPRESSOR

[75] Inventors: Dietmar E. B. Lilie; Jose L. Driessen; Marcio L. Todescat; Manfred Krueger, all of Joinville, Brazil

[73] Assignee: Empresa Brasileira De Compressores S/A-Embraco, Joinville, Brazil

[21] Appl. No.: 712,900

[22] Filed: Jun. 7, 1991

[30] Foreign Application Priority Data

Jun. 8, 1990 [BR] Brazil ..... 9002787

[51] Int. Cl.[5] ..... F04B 21/04

[52] U.S. Cl. ..... 417/566; 417/571; 417/DIG. 1; 137/855; 251/368

[58] Field of Search ..... 417/563, 566, 569, 570, 417/571, DIG. 1; 251/368; 137/855

[56] References Cited

U.S. PATENT DOCUMENTS

| | | | |
|---|---|---|---|
| 3,983,900 | 10/1976 | Airhart | 251/368 |
| 3,994,319 | 11/1976 | Airhart | 251/368 |
| 4,776,776 | 10/1988 | Jones | 417/566 |
| 4,786,031 | 11/1988 | Waldrop | 251/368 |

*Primary Examiner*—John J. Vrablik
*Assistant Examiner*—Charles G. Freay
*Attorney, Agent, or Firm*—Darby & Darby

[57] ABSTRACT

A reed valve for a hermetic compressor, comprising a cylinder block (1) having a pair of opposite faces; a cylinder (C) formed in said cylinder block (1) and housing a piston (2); at least one end plate (3) having an outer face (3*a*) and an inner face (3*b*) fixed to one of the opposite faces of the cylinder block (1), in order to close a respective end of the cylinder (C), and being provided with at least one pair of axial gas passages (6, 7) communicating the interior of the cylinder (C) with the outer face (3*a*) of the end plate (3) through a respective read valve (10), which is fixed to the face (3*a*) of the end plate (3), to which is opened the outlet end (6*b*, 7*b*) of the respective gas passage (6, 7), said valve comprising a blade element (10) with a body being formed of a resin that is preferably plastic and reinforced with fiber filaments (20, 21, 22) spaced from each other according to at least one direction relative to the longitudinal axis of the blade element (10).

16 Claims, 4 Drawing Sheets

REED VALVE FOR A HERMETIC COMPRESSOR

FIELD OF THE INVENTION

This invention relates to a hermetic compressor for small refrigerating machines and, more specifically, a reed valve to be used as a suction valve and/or a discharge valve in refrigeration hermetic compressors.

BACKGROUND OF THE INVENTION

The construction of reed valves for hermetic compressors directly affects their energy and volumetric efficiency. One of the losses is the energy loss due to overpressure related to the opening readiness of the discharge valve, after the discharge pressure has been reached within the compression chamber of the cylinder. In situations where the discharge valve does not open promptly, a condition of overpressure will occur inside the cylinder compression chamber. The longer the part of the compression cycle during said overpressure condition, the higher will be the effort and the power loss that the compressor crankshaft will have to overcome.

Another loss is the energy loss related to the opening readiness of the suction valve when the pressure inside the cylinder suction chamber reaches the suction pressure. If the suction valve does not open promptly, an underpressure condition will occur inside the cylinder suction chamber and the suction process will be delayed, causing energy and gas volume losses in the compressor.

There is also loss due to back flow, i.e. a mass loss relative to the closing readiness of the valve in the processes or operational steps of suction and discharge in the compressor.

From the above-mentioned, it can be said that a careful definition of the construction characteristics of the reed valves is one of the most important aspects in the hermetic compressor design. Any reed valve will present certain characteristic equations that control its behavior (motion). By simplifying the analysis using a model of mass and spring, we can say that the reed valve motion is defined by the following equations:

$$x = \frac{F(t)}{m} - fn2\,x - 2\,\epsilon fn\,x \quad (1)$$

$$\text{where } fn = \sqrt{\frac{k}{m}} = \text{valve natural frequency} \quad (2)$$

$$\epsilon = C/(2mfn) = \text{valve damping factor} \quad (3),$$

where:

x=valve displacement
F=pressure force on the valve
m=valve mass
k=valve stiffness
t=time Through the definition of fn and $\epsilon$, we may conclude that the valve response is in some measure determined by its geometry (dimensions) and material properties.

As mentioned above, the proper response of the valves in a compressor will strongly affect its performance. Considering an ideal operation, it can be concluded that the motion response of a reed valve to an optimum performance of the compressor will be attained by:

a total and immediate opening of the valve, as soon as the suction and discharge pressures are reached;
a situation in which the valve, after opening, is maintained fully opened till the flow is over; and
avoiding the high range fluctuations of the valve and the instability of the valve motion.

Furthermore, the valve must close rapidly after the suction or discharge process has ended in order to avoid back flow losses and, consequently, a decrease in the volumetric efficiency of the compressor.

This theoretical ideal performance is efficient in terms of power consumption, due to the reduction in the head loss of the gas flow through the gas discharge passage and the valve, and also in terms of an increase in the mass of volumetric efficiency, since it avoids any back flow loss and diminishes the delay in the opening of the valve.

A valve with the properties listed below can approximate the ideal motion conditions above mentioned.

high fn;
low k;
low inertia (small mass); and
damping effect (specific for each design)

All these properties are strongly dependent upon the material of the valve.

The high fn (natural frequency) is desired for a quick response of the valve to avoid the back flow losses. The small valve stiffness is desired to reduce overpressure (discharge) or underpressure (suction) which are necessary to open the valve and which result in energy loss in both cases, and also mass loss in case of suction. The small mass (specific weight) is necessary to reduce the valve inertia, so that the valve can respond more properly to pressure force, avoiding high amplitude fluctuations.

It should be noted that the general behavior of a valve is a function of k and fn, which are determined by the relationship between the modulus of elasticity, specific weight and material strength, as shown below.

$$\frac{k}{fn} \propto \frac{1}{\sigma adm} \sqrt{\rho E^4} \quad (4)$$

where:

$\sigma$ adm=admissible tension of the material
$\rho$=specific weight
E=modulus of elasticity Thus, in order to obtain a valve with a high natural frequency (fn) together with a reduced stiffness (k), the only possibility is to use a material that simultaneously presents a low specific weight, low modulus of elasticity and high strength.

Conventional reed valves for a hermetic compressor are usually made of hardened and tempered steel. One problem of the steel reed valves is that, for specified values of $\sigma$ adm and E, they present a high specific weight, thereby not being possible to minimize the k/fn relation. Thus, in order to obtain a desirable relation of high natural frequency and low stiffness for these known steel reed valves, the valve thickness has to be reduced, negatively affecting the valve strength. These limitations of the steel reed valves of the prior art deviate the valve performance from the ideal standard of response in terms of motion and cause a certain efficiency loss in terms of energy and mass of the compressor, as explained above.

OBJECTS OF THE INVENTION

It is an object of the present invention to provide a reed valve for a hermetic compressor used in small refrigerating machines that, notwithstanding its design, simultaneously has low mass, low stiffness, high natural frequency and high mechanical strength to bending and impact, and chemical compatibility with oils and halogenated fluid.

It is another object of the present invention to provide a reed valve, as above mentioned, which can be easily assembled and present an acceptable manufacturing cost.

BRIEF DESCRIPTION OF THE INVENTION

The reed valve of the present invention, is used in hermetic compressors comprising a cylinder block having a pair of opposite faces; a cylinder formed in said cylinder block, therein and having opposite ends which are opened to said opposite faces of the cylinder block, at least one end plate having an outer face and an inner opposite face attached to one of the opposite faces of the cylinder block, so as to close the respective ends of the cylinder. The end plate is provided with at least one pair of axial gas passages providing communication between the cylinder interior and with the outer face of the end plate through a respective reed valve. A piston is mounted inside the cylinder, so as to define therein, together with at least one end plate, a suction and compression chamber.

Each reed valve comprises a flexible blade element having a basic portion fixed to the face of the end plate to which is opened an outlet end of the respective gas passage. It also has a sealing portion that is movable between a closing position seated on the outlet end of the gas passage and an opening position spaced away from said gas passage outlet end. The motion of the sealing portion is caused by the elastic deformation of the blade element, due to the pressure differential between the interior of the cylinder and the outer face of the valve plate.

According to the present invention, each flexible blade element has a body preferably made of a plastic resin, reinforced with fiber filaments that are arranged spaced apart from each other, according to at least one direction relative to the longitudinal axis of the blade or the blade element.

The blade element, constructed as mentioned above, provides a reed valve having, simultaneously, little inertia (small mass of the material made of resin and fiber); low stiffness, together with an adequate strength as a result of the use of a flexible blade element; and a high natural frequency. More specifically, good results, to be discussed hereinafter, are obtained from a blade element made of plastic resin reinforced with filaments of carbon fiber, or glass fiber using, for example, the filament winding method, the fiber filaments being arranged into groups, according to a plurality of different directions, one of which corresponds to the longitudinal axis of the blade element.

DESCRIPTION OF THE DRAWINGS

The invention will hereinafter be described, with reference to the attached drawings, which illustrate the application of the present reed valve in a reciprocating hermetic compressor. However, it should be understood that the blade element object of the present invention can be applied to other types of hermetic compressors, such as the rotary type having a rolling piston and the rotary type having a sliding vane.

DETAILED DESCRIPTION OF THE INVENTION

Figure 1:
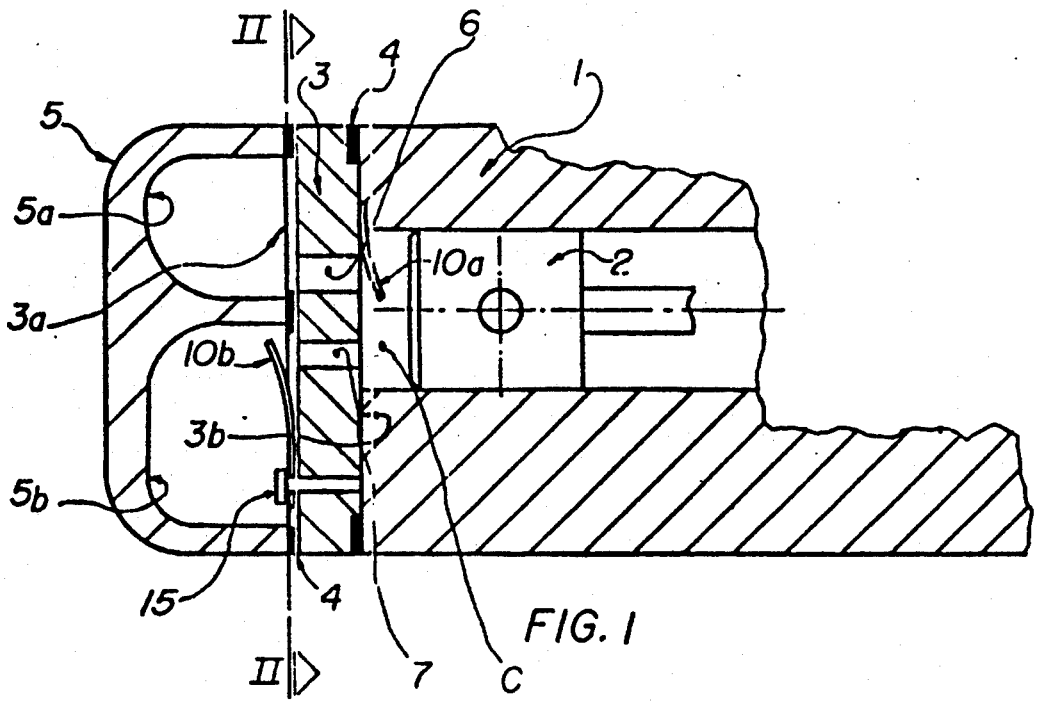
FIG. 1 shows a partial longitudinal section view of the cylinder block assembly, cylinder and piston of a reciprocating hermetic compressor.

As shown in FIG. 1, the compressor that was chose to represent a preferred embodiment of the invention is a reciprocating compressor of the type comprising a cylinder block 1 which is housed inside a hermetic case (not shown) and having a cylinder cavity within which reciprocates a piston 2.

The cylinder block 1 has a pair of opposite faces to which are opened the ends of cylinder C. Against one of said opposite faces of the cylinder block 1, there is fixed, through gaskets or joints 4, a valve plate 3 and a cylinder head 5. Head 5 forms with the valve plate 3, two inner cavities defining a suction chamber 5*a* and a discharge chamber 5*b*. The valve plate 3 has a front face 3*a* defining the suction and discharge chambers 5*a* and 5*b* of the cylinder head 5. One opposite face 3*b* of the valve plate faces the cylinder block 1 and defines together with the piston 2, a suction and compression chamber inside the cylinder C.

In the case of a rotary compressor, both ends of cylinder C are closed by end plates, usually defined by the flanges of the main and secondary bearings of the compression crankshaft, with at least one of the end plates operating as the valve plate.

Figures 3, 4:
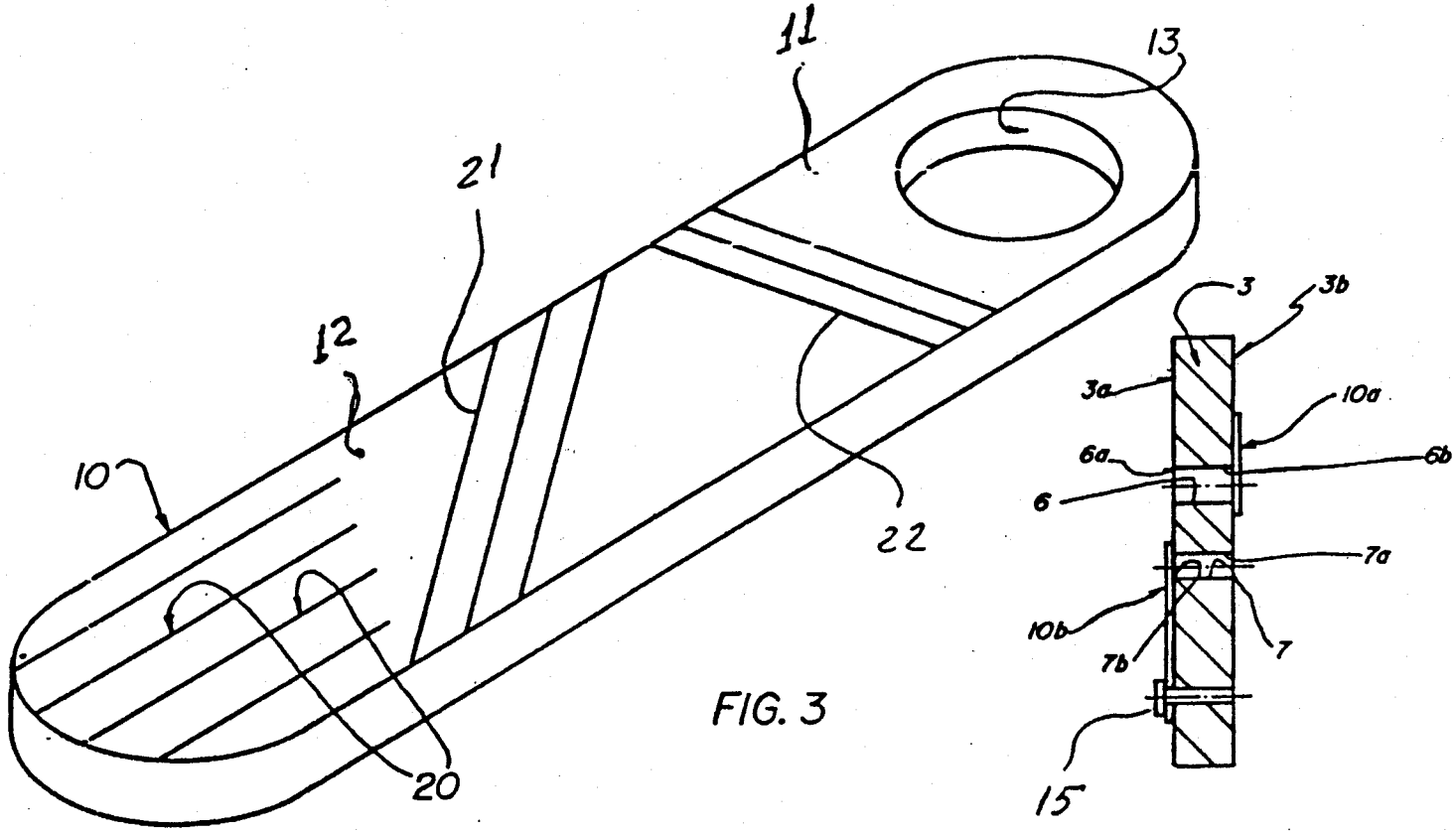
FIG. 3 is a perspective view of a blade element of the reed valve with a preferred arrangement for the reinforcement fiber filaments.
FIG. 4 is an enlarged lateral section view of the valve plate of FIG. 2 with the discharge reed valve being mounted thereto.

The cylinder C of the illustrated embodiment can be maintained in fluid communication with each one of the suction and discharge chambers 5*a*, 5*b* through respective axial gas holes or passages provided on the valve plate 3. In the embodiment illustrated, there is shown in FIG. 4, the front face 3*a* of the valve plate opposite to cylinder C which has the inlet end 6*a* and the outlet end 7*b* of a suction passage 6 and a discharge passage 7, respectively. The rear opposite face 3*b* of the valve plate has the outlet end 6*b* and the inlet end 7*a* of the suction and discharge passages 6 and 7, respectively.

Figure 2:
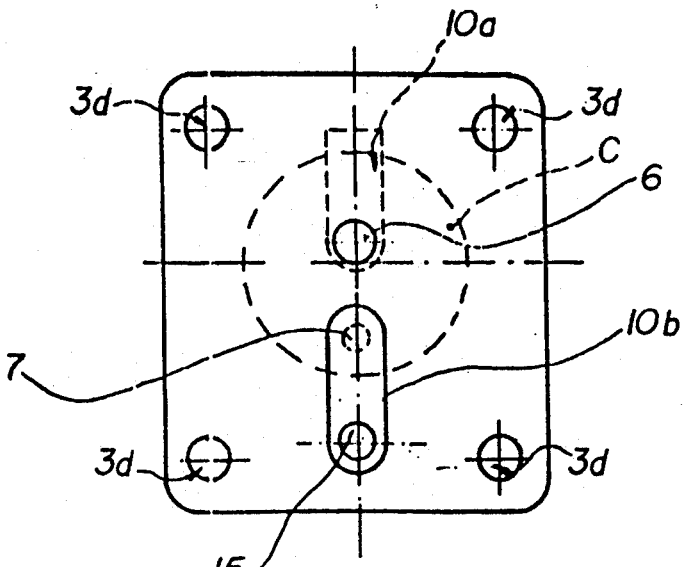
FIG. 2 shows an axial front view of the valve plate provided with a discharge reed valve and taken according to line II—II of FIG. 1.

At the outlet end of each axial gas passage 6 and 7, there is mounted a respective reed valve 10, designed according to the operative requirements of the compressors. FIG. 2 shows only the discharge reed valve 10 used in the illustrated compressor, said valve 10 being fixed to valve plate 3 at the outlet end 7*b* of the gas discharge passage 7.

As it can be seen in FIGS. 2, 3, and 4, the reed valve is formed by a flexible blade element 10 having a basic portion 11 and a sealing portion 12. The basic portion 11 is attached to the front face 3*a* of the valve plate to which is opened the outlet end 7*b* of gas discharge passage 7. The fixation of the blade element 10 is made by any known method as, for example, through a fastener, such as a bolt or rivet 15 disposed through a corresponding hole 13 provided at the basic portion 11 of the blade element 10.

Other known elements can also be provided to complete the assembly of the blade element 10 to the valve plate 3. One of said known elements is a stop (not shown). In the form of a rigid plate extending over the area situated above the outlet of each axial gas passage 6 and 7. The stop is to engage the sealing end 12 of the blade as it moves upwardly.

According to the present invention, the flexible blade element 10 has its body made of a reinforced resin with fiber filaments being arranged at least in one group. The fiber filaments being arranged at least in one group, the fiber filaments of each group are spaced from each other, at least one of the groups of fibers in parallel to a direction in relation to the longitudinal axis of the blade element 10. In the embodiment shown in FIG. 3, the body of the blade element 10 is made of a plastic resin reinforced with three groups of fiber filaments 20, 21 and 22, using the known filament winding technique to produce the individual filaments which are then arranged in the groups.

The first group of fiber filaments 20 is longitudinally arranged in relation to the longitudinal axis of the blade element 10, and the other two groups 21 and 22 are arranged in opposite directions in relation to each other, each one defining an angle of about 60° relative to the longitudinal axis of the blade element 10. The angles from the fiber groups 21 and 22 can be different from each other, but are preferably opposite to each other as shown in FIG. 3. The range can be from about 40°–75°. It is preferred that the fibers forming the various groups be laid down in the resin matrix parallel to the plane of the blade, but the fibers also can be angled upwardly or downwardly relative to the blade plane.

It was found out that, with the arrangement above mentioned and illustrated in FIG. 4 for the three different groups of fiber filaments 20, 21 and 22, it is possible to increase the blade element strength, by maintaining the stiffness values k adequately low, through a reduced thickness of the flexible blade element 10, and obtaining a high natural frequency fn as a function of the material (resin) used to form the body of the blade element.

Although the body of the blade element can be obtained from a plastic resin which, after having been reinforced with fiber filaments, presents the necessary low stiffness, high natural frequency and adequate strength, the following plastic resins proved to be appropriate to produce blade elements according to the present invention:

LCP=Liquid Crystal Polymer produced by Hoeschst with the name "Victrex".

PEEK=Polyetherketone manufactured by ICI with the name "Victrex".

PES=Polyethersulphone manufactured by ICI with the name "Victrex".

PI=Polyimide produced by DuPont with the name "Kapton" and by Mitsubishi with the name "BI".

PAI=Polyamide imide produced by Amoco with the name "Torlon".

The fiber filaments 20, 21 and 22 are preferably straight filaments of carbon fibers, e.g. filaments of carbon fibers having a tension modulus from 230 to 390 GPa of the "Celion" type produced by Celanese-USA. Filaments of aramide fibers can also be used and, in this type, there is the Kevlor aramide fiber produced by DuPont and presenting a tension modulus from 83 to 186 GPa.

Depending on the operative conditions of the compressor, filaments of glass fibers can also be used to reinforce the plastic resin of the blade element 10. In this case, it is possible to use glass fiber E or S in the dimension range from 5 to 20 μm.

The construction of the blade element according to the present invention leads to a valve having a natural frequency fn that is substantially increased in relation to the conventional steel reed valves known in the prior art. In this aspect, the advantages of the present invention become apparent through a comparative analysis of the diagrams shown in FIGS. 5 and 5*a*. There can be seen the large amplitude of the movement of the prior art suction valve (FIG. 5), having low fn and high k. This movement is improved through a smaller amplitude of the new blade element that allows obtaining, for a suction valve in the example of FIG. 5*a*, a larger number of short pulses for the "high fn and low k" combination.

In the case of the discharge valve, the new constructive solution of the blade element leads to a larger opening of the valve, as it can be seen by the area covered by the curves of the diagrams.

Figure 5:
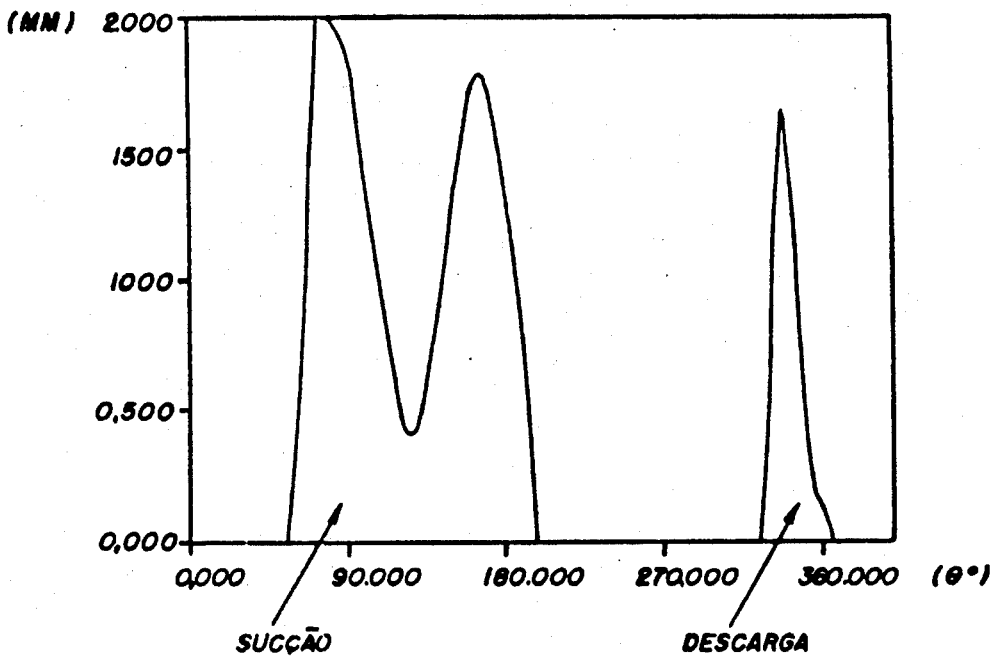
FIG. 5 is a diagram showing the opening and closing movements of the suction and discharge valves, with their respective blade elements having low fn and high k, according to the prior art.
Figure 5A:
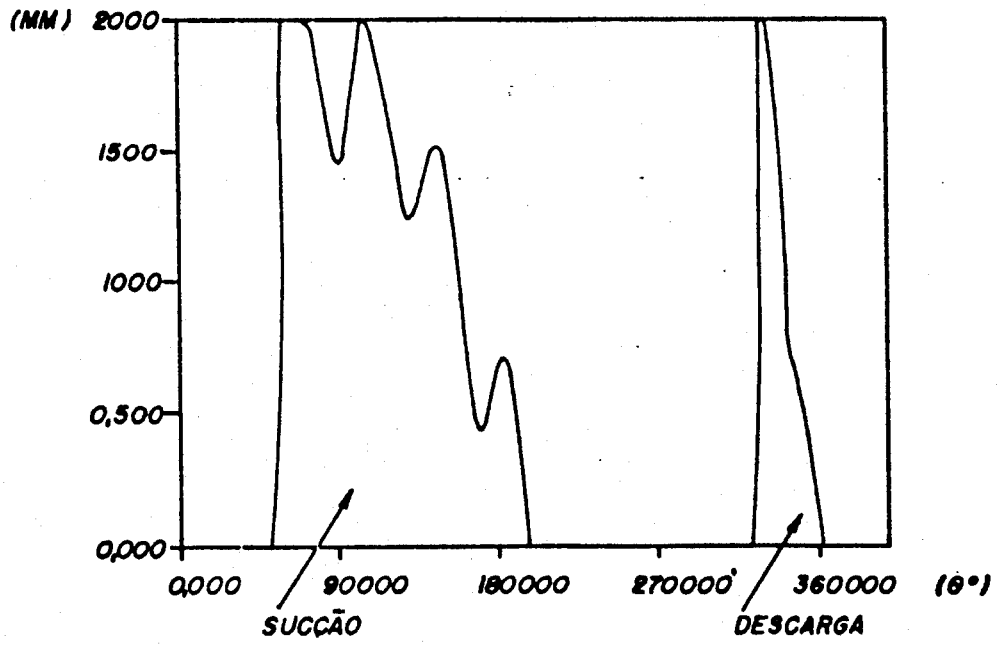
FIG. 5*a* is a diagram similar to that of FIG. 5, but showing the motion of the suction and discharge valves and high fn and low k, according to the present invention.

It should also be noted that both areas under the curves of the diagrams relative to the suction and discharge valves are substantially enlarged for the conditions of high fn and low k (FIG. 5*a*) in relation to the conditions of low fn and high k of the prior art (FIG. 5).

Figure 6:
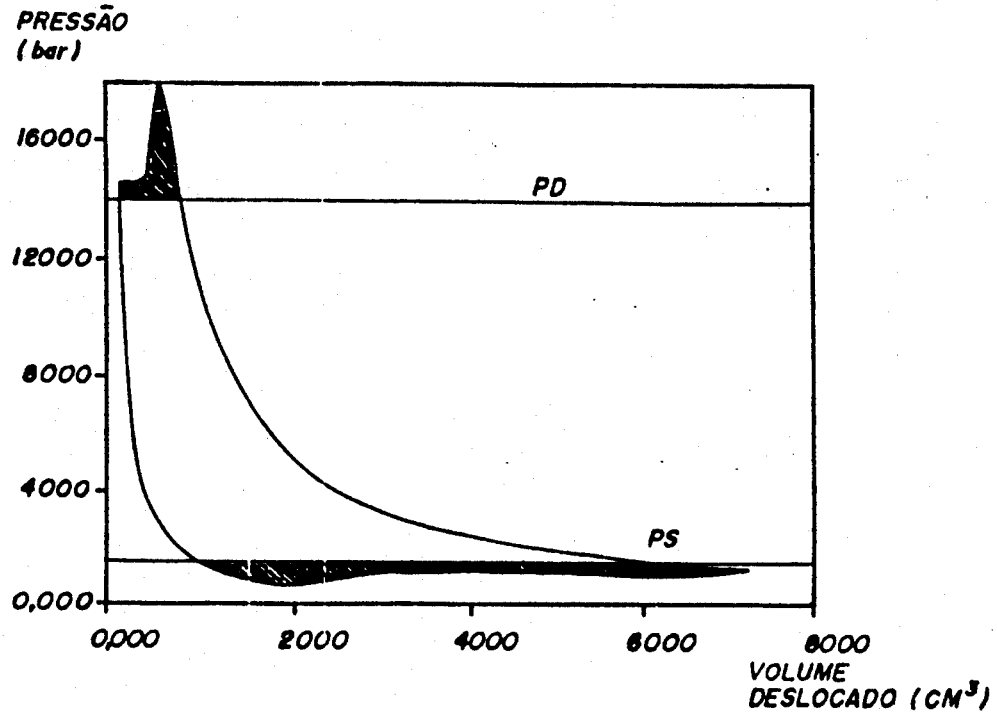
FIG. 6 is a diagram showing the pressure relative to the volume displaced by a piston during its displacement inside the cylinder, when the suction and discharge valves present low fn and high k, according to the prior art.
Figure 6A:
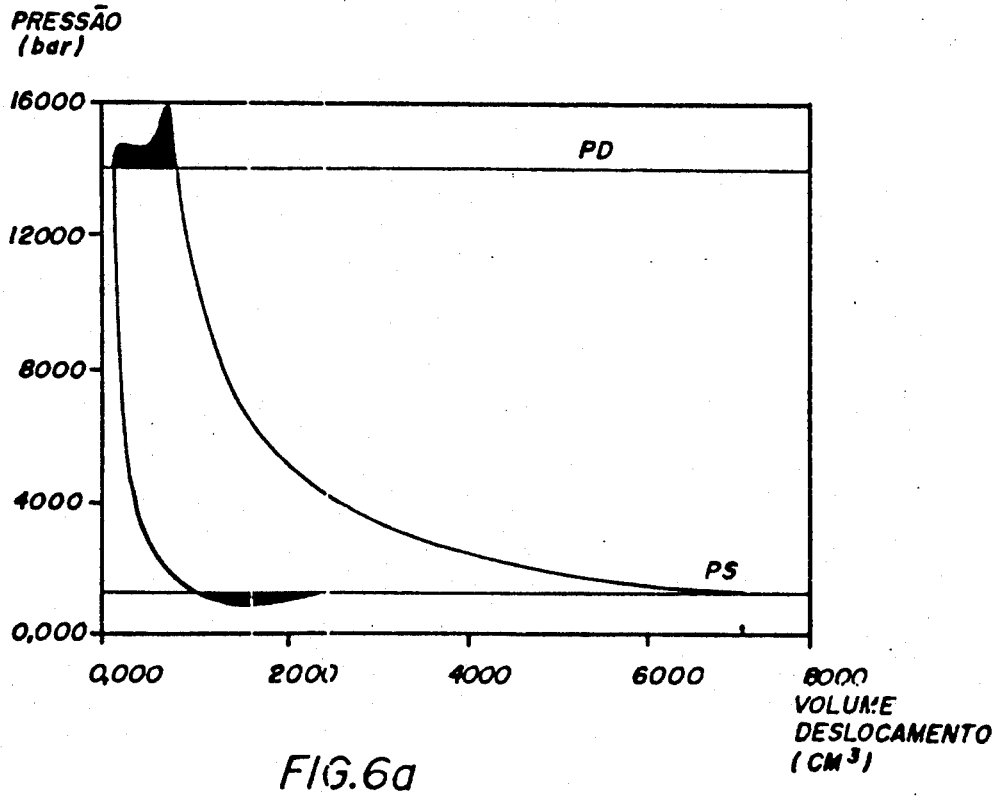
FIG. 6*a* is a diagram similar to that of FIG. 6, but relative to the use of a blade element having high fn and low k, according to the present invention.

In the diagrams of FIGS. 6 (prior art) and 6*a*, the cross-hatched areas represent the discharge losses (overpressure loss) and suction losses (underpressure loss). From the comparison between the diagrams of FIGS. 6 and 6*a*, it becomes evident the advantage of the "high fn and low k" combination obtained with the new blade element made of resin reinforced with fiber filaments.

We claim:

1. The combination comprising:

a compressor having a cylinder and a piston moving therein, first means attached to said cylinder including at least one gas passage therethrough for communicating with the cylinder, said gas passage having an outlet opening, a flexible valve member in the form of an elongated blade element having one end secured to said first means and another end for opening and sealing the gas passage outlet opening as the blade element is flexed in response to gas pressure, said blade element being formed of a resin which is reinforced with fiber filaments arranged in at least one group, each group of said at least one group comprising a plurality of parallel fiber filaments which occupy the thickness of the blade and are extended according to a respective direction in relation to the longitudinal axis of the blade element, said respective direction being maintained through the thickness of the blade element.

2. The combination according to claim 1, wherein said at least one group of fiber filaments extends in the direction of the longitudinal axis of the blade element.

3. The combination of claim 2, wherein the said at least one group of fibers is at the end of the blade which seals the gas passage opening.

4. The combination according to claim 2, wherein there are two other groups of fiber filaments spaced form each other and said at least one group and the two other groups extend in opposite directions to each other and at an angle in relation to the longitudinal axis of the blade element.

5. The combination of claim 4, wherein said angle is in the range from about 35° to about 75°.

6. The combination of claim 56, wherein said angle is 60°.

7. The combination according to claim 3, wherein there are two other groups of fiber filaments extending in opposite directions to each other and at an angle in relation to the longitudinal axis of the blade element, said two other groups of fibers lying in opposite directions and being located between the attached end of the blade element and the group of fibers at the sealing end of the blade.

8. The combination of claim 4, wherein said angle is in the range of from about 35° to about 75°.

9. The combination of claim 8, wherein said angle is 60°.

10. The combination according to claim 1, wherein the body of said blade element is made of a plastic resin.

11. The combination according to claim 9, wherein the plastic resin is selected from the group consisting of liquid crystal polymer (LCP); polyetherketone (PEEK); polyethersulfphone (PES); polyimide (PI) and polyamide imide (PAI).

12. The combination according to claim 1, wherein the fiber filaments are straight filaments.

13. The combination according to claim 1, wherein the fiber filaments are carbon fibers.

14. The combination according to claim 1, wherein the fiber filaments are filaments of aramide fibers.

15. The combination according to claim 1, wherein the fiber filaments are filaments of glass fibers.

16. The combination according to claim 1, wherein the fiber filaments have a tension modulus from about 83 to about 390 GPa.

* * * * *